US006308604B2

(12) United States Patent
Guzowski

(10) Patent No.: US 6,308,604 B2
(45) Date of Patent: Oct. 30, 2001

(54) APPARATUS FOR SPLITTING ARTICLES

(75) Inventor: Jacek Guzowski, Foster City, CA (US)

(73) Assignee: Genentech, Inc., South San Francisco, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,735

(22) Filed: Jun. 18, 1998

(51) Int. Cl.[7] ..... B26D 5/20

(52) U.S. Cl. ..... 83/257; 83/268; 83/270; 83/278

(58) Field of Search ..... 83/257, 268, 270, 83/276, 278, 440, 444, 18

(56) References Cited

U.S. PATENT DOCUMENTS

| | | | |
|---|---|---|---|
| 3,490,323 | 1/1970 | Jensen et al. . | |
| 3,759,122 | 9/1973 | Lane et al. . | |
| 4,054,074 | 10/1977 | Martensson et al. . | |
| 4,230,008 | 10/1980 | Fornwalt et al. . | |
| 4,738,177 | 4/1988 | Jones, III et al. . | |
| 4,921,154 | 5/1990 | Abe et al. . | |
| 5,127,211 | 7/1992 | Mancini . | |
| 5,192,011 | 3/1993 | Fuchs . | |
| 5,347,898 | 9/1994 | Ito . | |
| 5,503,885 | 4/1996 | Anderson . | |
| 5,517,888 | 5/1996 | Ray . | |
| 5,709,138 * | 1/1998 | Rimer | 83/18 |
| 5,839,337 * | 11/1998 | Neu | 83/255 |

FOREIGN PATENT DOCUMENTS

| | | |
|---|---|---|
| 37 32 269 A | 4/1989 | (DE) . |
| 2 674 473 A | 10/1992 | (FR) . |
| 2 175 565 A | 12/1986 | (GB) . |
| 2 175 836 | 12/1986 | (GB) . |

* cited by examiner

*Primary Examiner*—Lee Young
*Assistant Examiner*—Rick Kiltae Chang
(74) *Attorney, Agent, or Firm*—Oblon, Spivak, McClelland, Maier & Neustadt, P.C.

(57) ABSTRACT

A splitting apparatus includes a splitter member with a plurality of blades, and a splitting guide configured to anchor articles so that an article to be split is anchored on a splitting guide when the splitter member is moved across the splitting guide. The apparatus includes a gate which is controlled by a gate controller that selectively opens and closes the discharge aperture positioned adjacent the splitting guide so that the split article can be discharged from the splitting guide. A staging platform is provided adjacent the splitting guide for aligning the articles to be split with the splitting guide and a staging advancer is provided to move articles from the staging platform to the splitting guide, and to discharge the split articles after splitting.

32 Claims, 6 Drawing Sheets

APPARATUS FOR SPLITTING ARTICLES

BACKGROUND OF THE INVENTION

1. Field of the Invention

The present invention relates to a method and apparatus for splitting articles. More particularly, the invention is concerned with splitting articles which are formed of a plurality of integrally formed containers.

2. Description of the Related Art

In the area of pharmaceutical packaging and distribution, pharmaceutical substances are commonly packaged in small vials made of glass or plastic known as ampoules. Ampoules can be made in a variety of sizes, and are commonly made so that each ampoule holds approximately one dose of a particular pharmaceutical. Recently, mass produced ampoules have been constructed such that a plurality of ampoules are simultaneously and integrally formed into a belt-like configuration.

For example, U.S. Pat. No. 5,503,885 issued to Anderson, which is hereby expressly incorporated by reference, teaches a method and apparatus for manufacturing ampoule cards wherein each card comprises a plurality of integrated ampoules. The cards are made out of a soft plastic where each ampoule is attached to one another by means of a weakened line or score in the soft plastic between each individual ampoule. Although any number of ampoules may be formed into an ampoule card, it is common to receive ampoule cards that include 6 ampoules.

Ampoules typically have a flat end and an enlarged end wherein the enlarged end provides a vessel for storing a substance and the flat end provides a grip for handling the ampoule. Therefore, in order to minimize packaging and transportation costs, ampoule cards are typically stacked in alternating layers facing opposite directions so that the enlarged ends are nested with the flat ends. Once the nested ampoule cards are received, it is desirable that the cards be split into individual ampoules so that they may be individually packaged for safety or longevity purposes. For example, a particular pharmaceutical may last longer if it is stored in the dark. Such a container would preferably be individually wrapped in a lightproof wrapper and packaged, together with a plurality of other wrapped ampoules, into a box. Packaged as such, many ampoules can be provided in a box so that unused ampoules are not exposed to light when the box is opened.

In order to separate ampoule cards into individual ampoules, it has been known to punch, knock or push the containers so as to break the reduced thickness sections between the individual ampoules. However, it has been found that such methods involve substantial manual labor costs.

A further disadvantage arises when it is necessary to split ampoule cards that are stacked alternately facing opposite directions and it is desired that the individual ampoules face the same direction after being split from the ampoule cards.

SUMMARY OF THE INVENTION

Accordingly, it is an object of the present invention is to provide a method and apparatus for splitting articles such as ampoule cards that satisfy the aforementioned requirements.

It is another object of this invention to provide a novel method and apparatus for splitting articles that can quickly and reliably split ampoules and discharge them so that they are aligned facing the same direction.

These and other objects are achieved according to the present invention by providing a splitting apparatus including a splitter member with a plurality of blades, a splitter advancer configured to move said splitter member along a cutting path, a splitting guide configured to receive an ampoule card and provided substantially in the cutting path of the splitter member, wherein the splitter member is configured to translate across the splitting guide such that an ampoule card supplied to the splitting guide is split in a direction substantially parallel to the longitudinal axes of the ampoules.

According to a further aspect of the invention, an article splitting apparatus is provided which includes a splitting guide configured to receive an article to be split and to align the article with a cutting path. A splitter member including a plurality of blades is also provided where the blades are configured to split an article in the splitting guide. A splitter advancer is provided to move the splitting member along the cutting path. Furthermore, a rotating platform is provided which is configured to selectively rotate articles before they are moved to the splitting guide.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
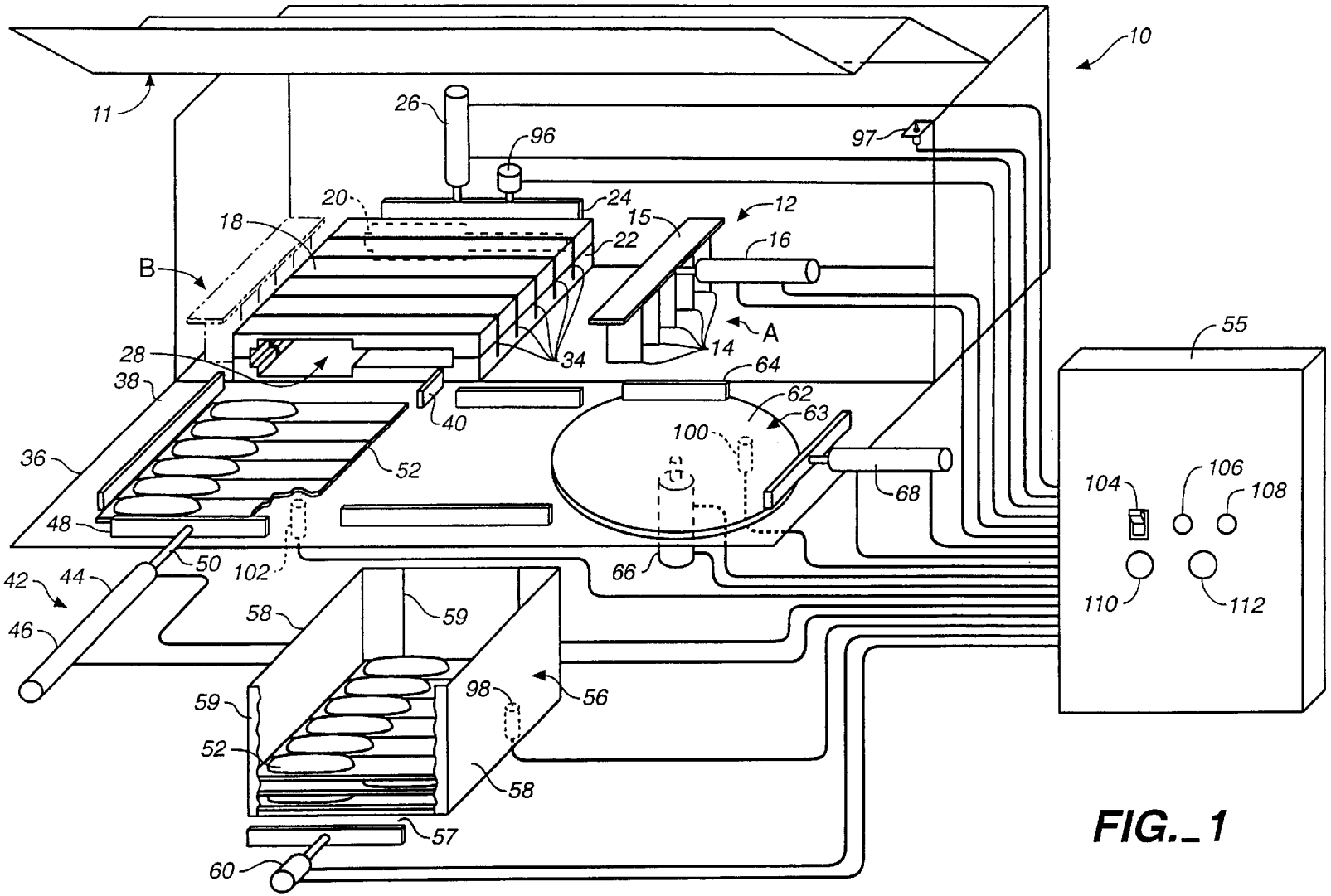
FIG. 1 is a perspective view of the splitting apparatus of the present invention.
Figure 2:
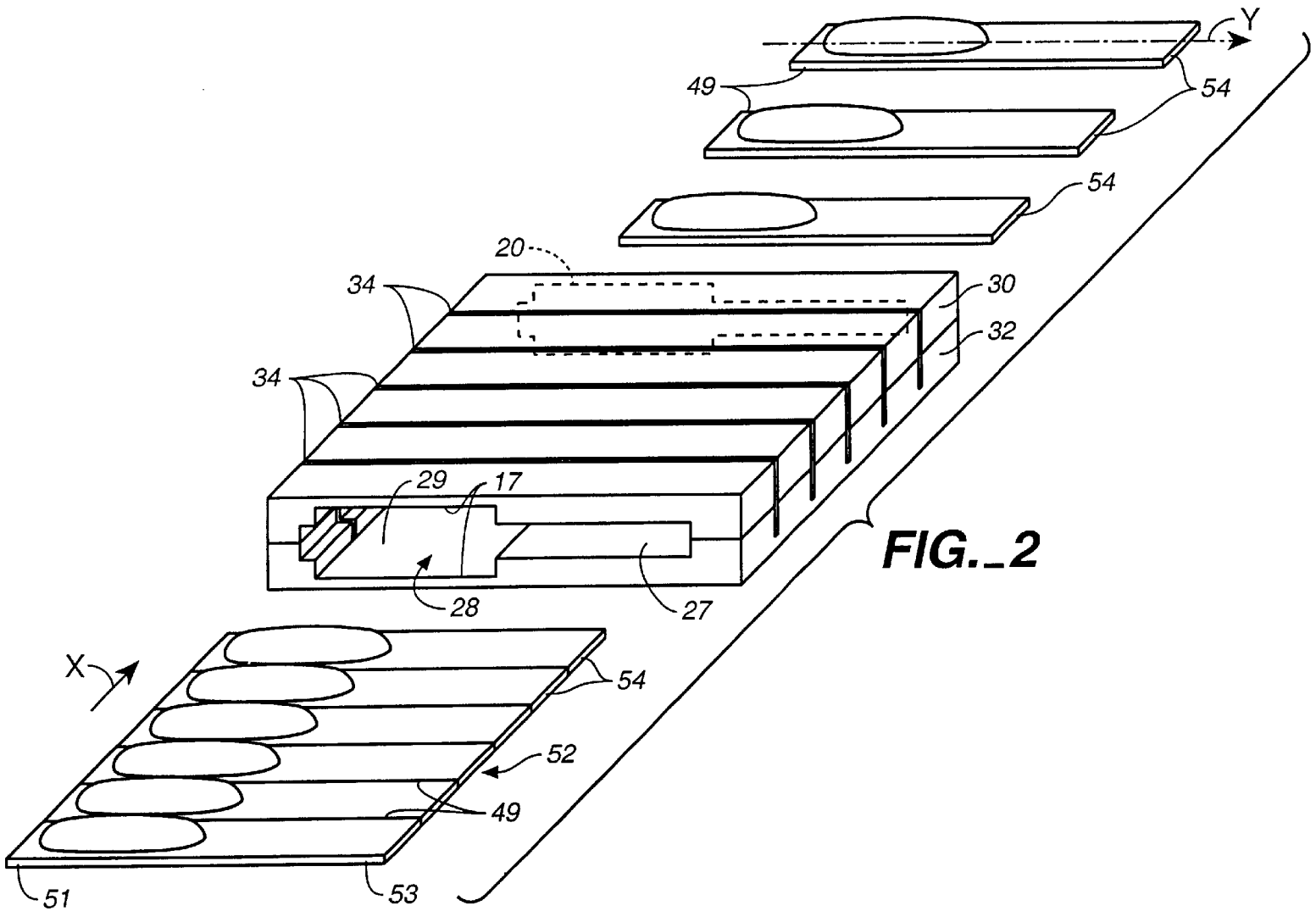
FIG. 2 is an enlarged perspective view showing an ampoule card and a splitting guide according to the present invention.

Referring now to the non-limiting example of the drawings, wherein like reference numerals designate identical or corresponding parts throughout the several views, and more particularly to FIGS. 1 and 2 thereof, a splitting apparatus embodying the present invention is shown and optionally includes a housing 10 which generally encloses the area where articles are cut into smaller elements. Housing 10 may have a cover 11 which can be opened to gain access to the interior of the housing. Alternatively, housing 10 may be omitted and cover 11 may be attached to any known bracket or support (not shown). Inside housing 10, splitting member 12 may be constructed of a horizontal cross bar 15 provided with a plurality of blades 14, and is mounted for horizontal movement by a splitter advancer 16. The range of movement provided by splitter advancer 16 through which blades 14 moves defines a cutting path of blades 14 of splitter member 12. Also provided in housing 10, is splitting guide 18 which is arranged substantially in a cutting path of blades 14 of splitter member 12. Discharge aperture 20 is provided in a rear side 22 of splitting guide 18.

Gate 24 is provided adjacent discharge aperture 20 and is provided with gate controller 26 which selectively moves gate 24 to open or close aperture 20.

Splitting guide 18 is preferably provided with channel 28 which is configured to receive an ampoule card to be split, such as an ampoule card 52. However, splitting guide 18 may be configured to receive any article which is desired to be split. As shown in FIG. 2, ampoule card 52 comprises a plurality of individual ampoules 54 spaced in a first direction X which is substantially perpendicular to the longitudinal axis Y of the individual ampoules 54. The individual ampoules 54 are attached to each other along their longitudinal edges 49. Splitting guide 18 may be constructed of one piece, however, guide 18 preferably comprises upper part 30 and lower part 32, each of which include recesses 17. Upper part 30 and lower part 32 may be connected to each other by any standard fasteners such as clamps, threaded fasteners, adhesives or the like. When parts 30 and 32 are arranged in a face-to-face relationship, recesses 17 form channel 28. Parts 30 and 32 also include blade grooves 34 which are configured to allow blades 14 to pass through them when splitting member 12 is urged along its cutting path. Preferably, channel 28 is provided with a narrow end 27 and an enlarged end 29 which are sized to correspond to the flat end 53 and the enlarged end 51 of ampoule card 52. Furthermore, in order to provide a good fit between the ampoule card and channel 28, narrow end 27 is preferably narrower than enlarged end 51 of ampoule card 52. Proportioned as such, channel 28 provides optimal protection against misalignment of ampoule card 52 during splitting.

The splitting apparatus may also be provided with staging platform 36 which is arranged adjacent to splitting guide 18. Staging platform 36 may be provided with guide rails 38 and 40 and staging advancer 42. Staging advancer 42 preferably comprises a pneumatic air cylinder with stage 44 and 46 and end plate 48 at its moving end 50, although any fluid cylinder or an electric servomotor could also be used. Preferably, a programmable logic controller (PLC) 55 controls splitting advancer 16, gate controller 26, and staging advancer 42.

In operation, the staging platform 36 is provided with ampoule card 52 from an outside source. Thereafter, staging advancer 42 urges ampoule card 52 into the splitting guide 18. Preferably, staging advancer 42 extends such that end plate 48 pushes ampoule card 52 into channel 28 provided in guide 18 so that the longitudinal axis Y of the individual ampoules is substantially parallel with the cutting path of blades 14. In order to prevent ampoule card 52 from falling through discharge aperture 20, gate 24 is lowered over aperture 20 by gate controller 26. Preferably, moving end 50 of staging advancer 42 holds end plate 48 against ampoule card 52 so that ampoule card 52 is in contact with end plate 48 and gate 24, thereby maintaining good alignment between ampoule card 52 and splitting guide 18. Once ampoule card 52 is in proper alignment with splitting guide 18, splitting member 12 is moved across its cutting path by splitting advancer 16, which may be any kind of fluid cylinder or an electric servomotor. Preferably, blades 14 have such a length that they completely cut through the material connecting individual ampoules provided on ampoule card 52. However, it is conceived that blades 14 may have such a length they slit the material between the ampoules, and leave behind a thin, easily separated residual thickness.

After splitting member has split ampoule card 52 into smaller elements 54, staging advancer 42 may be further extended by second stage 44, such that end plate 48 is urged substantially through channel 28 thereby urging smaller elements 54 out of splitting guide 18 and through aperture 20.

In another embodiment, the splitting apparatus may include a magazine for holding a stack of ampoule cards 52 to be fed to the splitting guide 18. Magazine 56 generally comprises two solid vertical walls 58 and two open vertical walls 59. However, magazine 56 may be constructed in any known manner which enables a plurality of stacked articles, such as ampoule cards 52, to be ejected laterally, one or more at a time, from the bottom of the stack.

Preferably, magazine 56 includes magazine advancer 60 provided at a lower end 57 of magazine 56, and arranged so as to horizontally eject a single ampoule card 52 from the bottom of the stack of ampoule cards 52 in magazine 56. Preferably, magazine advancer 60 is configured such that after ejecting an ampoule card 52 from the bottom of the stack of ampoule cards, and advancer 60 is then retracted, the stack of ampoule cards then drops in the magazine. By providing the splitting apparatus with magazine 56, stacks of ampoule cards 52 may be loaded into magazine 56 where single ampoule cards may thereby be continuously fed to staging platform 36. Although not shown in the figure, magazine 56 may be provided adjacent staging platform 36 so as to feed ampoule cards 52 to staging platform 36. Alternatively, magazine 56 may be provided on staging platform 36 and staging advancer 42 may be arranged to move a single ampoule card 52 from the bottom of magazine 56, directly to splitting guide 18.

In a preferred embodiment, ampoule cards are stacked alternately in opposite facing directions, with the enlarged end 51 nested with flat ends 53 to prevent damage in shipping. Such an arrangement allows ampoule cards to be packaged in bulk with a maximum possible density and furthermore, the resulting stacks are more stable. Therefore, ampoule cards are typically received in stacks where cards 52 are stacked alternately in opposite directions, as can be seen in FIG. 1 where ampoule cards 52 are stacked as such in magazine 56. Therefore, when ampoule cards 52 are received as such, it is preferable to provide the apparatus with means for alternately rotating ampoule cards 52 so that they face the same direction before being split into smaller elements 54.

In order to rotate ampoule cards 52, rotating platform 62 may be provided adjacent staging platform 36, as shown in FIG. 1. Preferably, rotating platform 62 includes a rotatable substrate 63 connected to a rotating controller 66, and a guide rail 64. Since ampoule cards are typically received alternately rotated 180°, it is preferable that rotating platform 62 is configured to rotate every other ampoule card 52 180° so that all ampoule cards 52 fed into staging platform 36 face the same direction. Preferably, rotating platform 62 is rotated by rotating controller 66 which is controlled by PLC 55.

In order to provide continuous feeding of articles such as ampoule cards to rotating platform 62, magazine 56 may be provided adjacent rotating platform 62, as shown in FIG. 1. Arranged as such, alternately stacked ampoule cards 52 can be inserted into magazine 56 and can be fed one at a time onto rotating platform 62 by magazine advancer 60. Because they are alternately stacked in opposite facing directions, only every other ampoule card 52 must be rotated. Therefore, PLC 55 preferably controls rotating platform 62 such that only every other ampoule card 52 is rotated. Once rotating platform 62 has either rotated ampoule card 52 or selectively skipped that particular ampoule card 52, rotating platform advancer 68 advances ampoule card 52 to staging platform 36.

Figure 3:
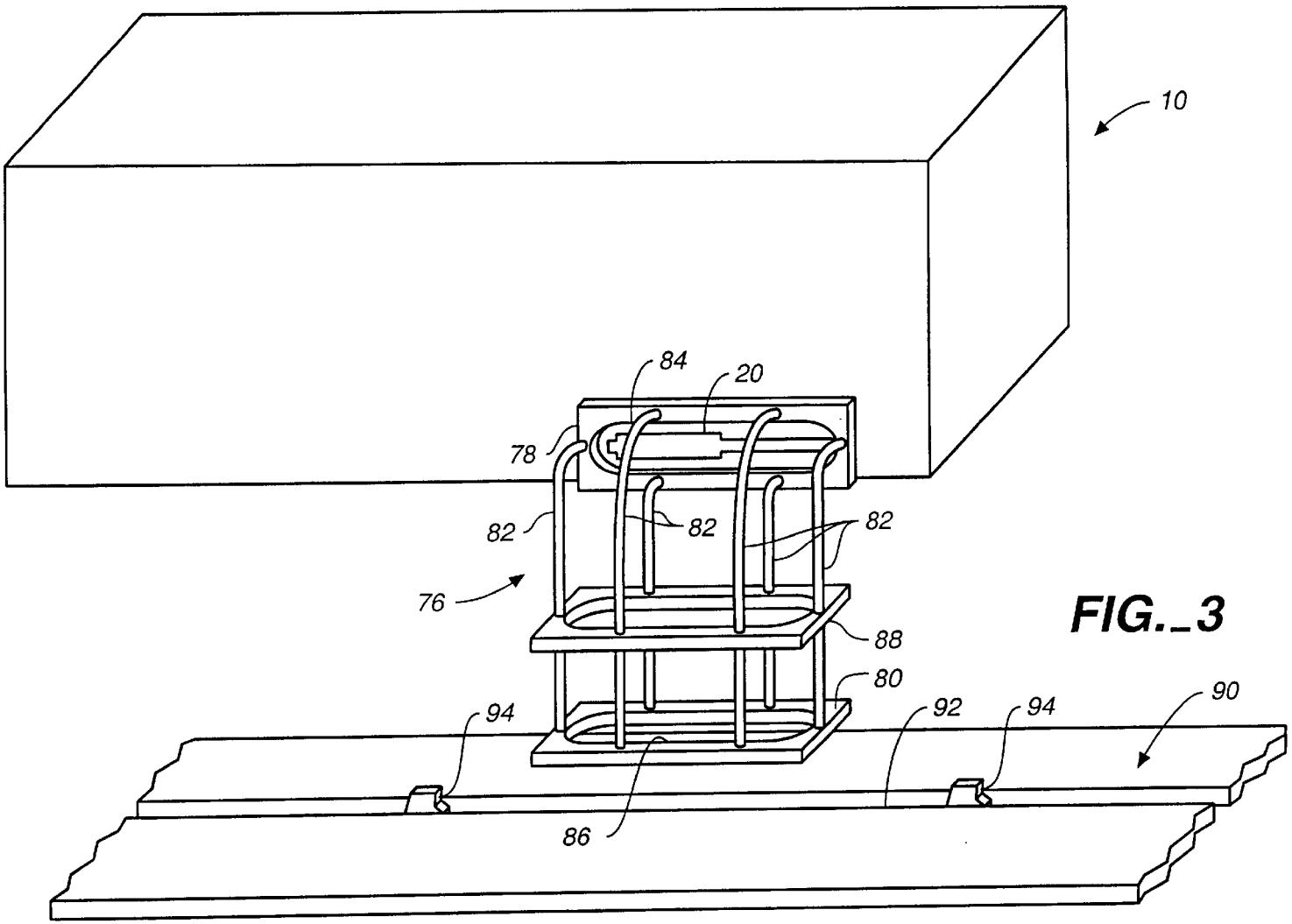
FIG. 3 is a perspective view of a discharge chute and a conveyor according to a further embodiment of the present invention.

A further embodiment of the present invention is shown in FIG. 3. As shown in the figure, discharge chute 76 is provided adjacent to aperture 20 on a rear side of housing 10. Discharge chute 76 includes an input port 78, output port 80 and may include a plurality of rails 82 arranged to form a path leading from aperture 84 in input port 78 to output aperture 86 formed in output port 80. However, it is conceived that any known structure may be used to form a discharge path from input port 78 to output port 80. Preferably, discharge chute 76 includes support ring 88 which is positioned approximately midway along rails 82 in order to provide support for rails 82. Furthermore, in order to maximize the speed of operation of the present invention when used in conjunction with an assembly line, output port 80 of discharge chute 76 may be aligned with a conveyor 90 such that split elements 54 leaving discharge chute 76 are guided to conveyor path 92 and urged along path 92 by conveyor member 94.

In operation, when split elements 54 are discharged through discharge aperture 20, they are guided along a discharge path defined by rails 82. Preferably, output port 80 of discharge chute 76 is provided adjacent the conveyor 90. Split elements 54 leaving aperture 20 and traveling through the discharge path defined by rails 82, are guided into conveyor path 92 and further urged along path 92 by conveyor member 94. Conveyor 90 thereby conveys split elements 54 to further processing stations such as wrapping or packaging machines (not shown).

It is preferable that, during operation, splitting element 12 is configured to cut in both directions. For example, a first ampoule card 52 may be moved to splitting guide 18, and split by blades 14 by moving splitting member 12 from position A to position B (shown in dashed lines) as viewed in FIG. 1. Staging advancer 42 can then be activated to push the split elements 54 out discharge aperture 20 while splitting member is in position B. This is possible because splitting guide 18 includes blade grooves 34 which allow blades 14 to pass through guide 18 and beyond channel 28 so that end plate 48 and rod 50 of staging advancer 42 can travel through channel 28 until end plate 48 is adjacent aperture 20. After split members of the first ampoule card 52 have been discharged from aperture 20, end plate 48 and rod 50 are pulled back to the position shown in FIG. 1 so that another ampoule card can be moved to the staging platform 36. Once a second ampoule card 52 is moved to staging platform 36, staging advancer 42 moves the second ampoule card 52 to splitting guide 18. Thereafter, splitting element 12 is pulled back towards splitting advancer 16 to position A, thereby splitting second ampoule card 52 into smaller elements 54, and the process is repeated as before.

Preferably, PLC 55 controls the timing of all cylinders so that the splitting process is fully automated. PLC 55 preferably includes a power selector switch 104 for turning the PLC on and off, an indicator light 106 for indicating when power is on, an alarm light 108 for indicating a failure of the system, a start button 110 and a stop button 112.

Figure 4:
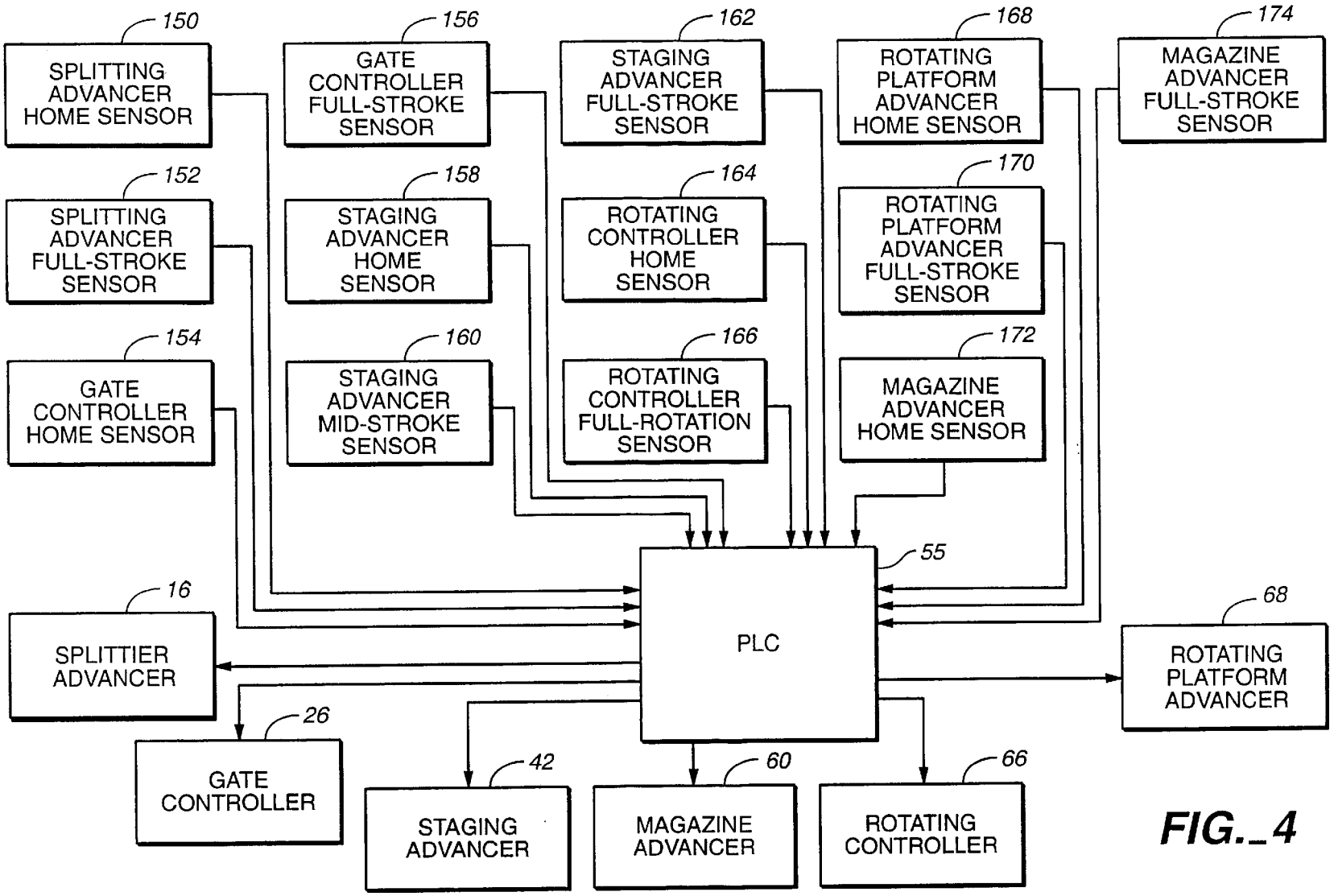
FIG. 4 is a schematic representation of the controller of the present invention.

In the presently preferred embodiment, each of the advancers 16, 26, 42, 60, and 68 comprise air cylinders that have sensors, schematically represented in FIG. 4, which are well known in the art and which are positioned so as to generate a signal when the piston (not shown) inside the cylinders is at a home position and at a full-stroke position. Since it is preferable that advancer 42 be able to stop at a half stroke position, it is preferable that advancer 42 further include a third sensor at a position between a home position and a full-stroke position to generate a signal when advancer 42 is at a mid-stroke position. For example, PLC 55 may be configured to receive input from splitting advancer home sensor 150, splitting advancer full-stroke sensor 152, gate controller home sensor 154, gate controller full-stroke sensor 156, staging advancer home sensor 158, staging advancer mid-stroke sensor 160, staging advancer full-stroke sensor 162, rotating cylinder home sensor 164, rotating cylinder full-rotation sensor 166, rotating platform advancer home sensor 168, rotating platform advancer full-stroke sensor 170, magazine advancer 172, and magazine advancer full-stroke sensor 174, and to provide output signals to splitting advancer 16, gate controller 26, staging advancer 42, magazine advancer 60, rotating controller 66, and rotating platform advancer 68.

In operation, PLC 55 may be configured or programmed so that, upon actuation, magazine advancer 60 moves from a home position to a full stroke position, thereby moving an ampoule card 52 from the bottom of magazine 56 to the rotating platform. Once magazine advancer full-stroke sensor 174 detects that the advancer 60 has performed a full stroke, PLC 55 can signal rotating platform advancer 68 to extend and thereby advance an ampoule card to staging platform 36. Once PLC 55 receives a signal from rotating platform advancer full-stroke sensor 170, PLC 55 can signal advancer 42 to extend and thereby move an ampoule card 52 to splitting guide 18. Preferably, PLC 55 stops advancer 42 when PLC 55 receives a signal from staging advancer mid-stroke sensor 160 and thereby maintains advancer 42 at this point so that end plate 48 remains in close proximity, or in contact with the ampoule card 52 such that ampoule card 52 is in contact with wall 48 and gate 24. Positioned as such, proper alignment of the ampoule card within splitting guide 28 is ensured. Preferably, PLC 55 delays the advancement of an ampoule card 52 into splitting guide 18 until PLC 55 receives a signal from gate controller full-stroke sensor 156 indicating that gate 24 is closed, which thereby prevents an ampoule card 52 from inadvertently passing through aperture 20 before it is split. Once staging advancer is extended to the proper position for splitting, PLC 55 signals splitter advancer 16 to extend such that splitter member 12 and blades 14 are moved along the cutting path, thereby splitting ampoule card 52 into smaller elements such as individual ampoules 54. PLC 55 is preferably configured such that splitting member 12 can split ampoules when splitting advancer 16 is extending or retracting splitter member 12.

Once the ampoule card has been split, and PLC 55 receives a signal from splitting advancer full-stroke sensor 152 indicating that the splitter member 12 is in position B, PLC 55 signals gate controller 26 to open and subsequently signals staging advancer 42 to further extend substantially into splitting guide 18 such that the individual ampoules 54 are discharged through aperture 20. Preferably, PLC 55 delays the advancement of advancer 42 until PLC 55 receives a signal from gate controller home sensor 154 indicating that gate 24 is open. The splitting process can then be repeated as desired.

As described above, PLC 55 can be configured or programmed to signal rotating controller 66 in order to rotate platform 62 in such a manner so as to rotate alternating ampoule cards 52. In such a configuration, PLC 55 can be programmed or configured to signal rotating controller 66 after receiving a signal from magazine advancer full-stroke sensor 174 and magazine advancer home sensor 172 which would respectively indicate that an ampoule card 52 has been pushed to rotating platform 62 and that magazine advancer 60 has been retracted to a home position, which would ensure that advancer 60 does not collide with guide rail 64 on rotating platform 62. Upon receiving such signals, PLC 55 can signal rotating controller 66 to rotatable substrate 63 until PLC 55 receives a signal from rotating cylinder full-rotation sensor 166, which thereby rotates the ampoule card 52 approximately 180°. PLC 55 can then signal advancer 68 to move ampoule card 52 to staging platform 36, then retract to its home position. Once PLC 55 receives a signal from rotating platform advancer home sensor 168, indicating that advancer 68 is in a home position, PLC 55 can signal rotating controller 66 to rotate rotating substrate 63 to a home position, thereby preventing guide rail 64 from colliding with advancer 63.

Figure 5:
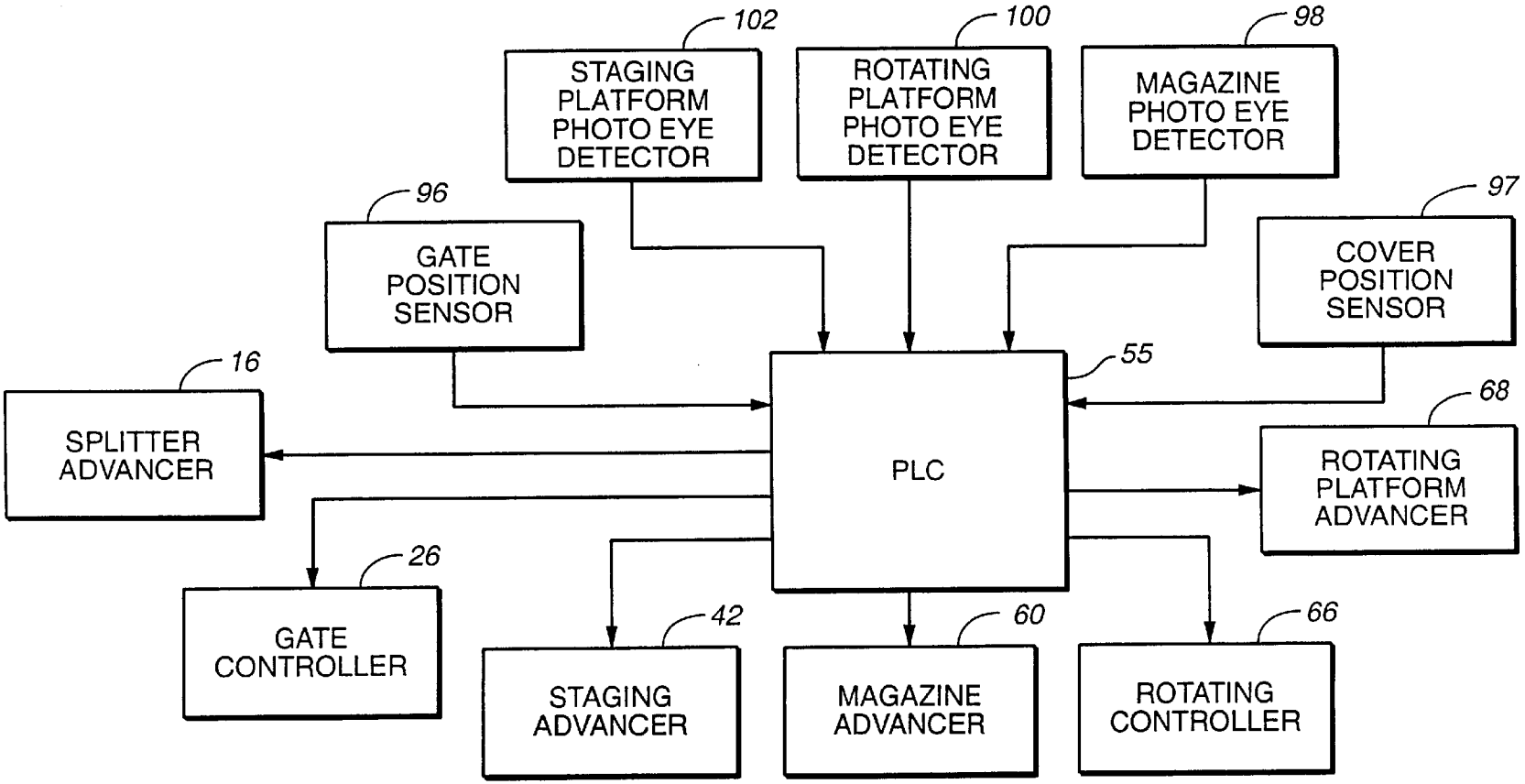
FIG. 5 is a schematic representation of an alternative embodiment of the controller of the present invention.

In an alternative embodiment, staging platform 36, rotating table 62 and/or magazine 56 may be provided with detectors 98, 100, 102 which are connected to PLC 55. For example, referring now to FIG. 5, PLC 55 can preferably receive input from gate position sensor 96, staging platform detector 102, rotating platform detector 100, magazine detector 98 and cover position sensor 97, and can provide output signals to splitting advancer 16, gate controller 26, staging advancer 42, magazine advancer 60, rotating controller 66, and rotating platform advancer 68. These detectors enable the splitting apparatus to control the various components according to the presence of article to be split, rather than the position of the components. These detectors are preferably photo detectors, but may instead be mechanical, electrical, or any other type of detector. In operation, PLC 55 monitors at least one of these positions in order to determine whether an ampoule card 52 is positioned at one of these locations. Accordingly, PLC 55 stops or starts the splitting process according to whether there are any ampoule cards present. For example, PLC 55 may be configured to automatically begin the splitting process when an ampoule card is loaded into magazine 56, thereby triggering detector 98. PLC 55 may further be configured to stop the splitting process when, for example, no ampoule card is detected by detector 102 after an attempt has been made to push an ampoule card to the staging platform 36. However, for safety concerns, it is preferred that PLC 55 is manually prompted to begin a splitting process.

Therefore, PLC 55 may alternatively be manually operated wherein it is first powered on by an operator by moving power selector switch 104 to an "on"position, then depressing the start button 110. PLC 55 can be configured to either start when the start button 110 is triggered, and only after one of the detectors signals PLC 55 that an ampoule card is present.

Furthermore, PLC 55 may be configured to alternately rotate ampoule cards fed to it by monitoring detector 100. In operation, PLC 55 can signal rotating controller 66 to rotate alternating ampoule cards provided to rotating substrate 63 by monitoring the placement of ampoule cards on substrate 63 with detector 100.

In an embodiment which includes magazine 56, PLC may be configured such that the splitting operation will not begin unless detector 98 signals PLC 55 that a light blocking member, such as an ampoule card, is present. Thereafter, PLC 55 signals magazine advancer 60 advancer to extend such that an ampoule card is urged onto the rotating platform 62. Once detector 100 signals that an ampoule card is present, PLC 55 can determine, whether that ampoule card must be rotated. One configuration of PLC 55 could be that the first ampoule card is assumed to be facing in the proper direction, and thereafter, every other ampoule card is rotated 180 degrees. After PLC 55 has either rotated ampoule card 52, or not, PLC 55 can signal rotating platform advancer 68 to extend such that the ampoule card 52 is pushed to staging platform, then retract advancer 68. Once the ampoule card triggers detector 102, and gate position sensor indicates to PLC 55 that the gate is in a lowered position, PLC 55 can signal staging advancer 42 to extend such that the ampoule card is pushed into splitting guide 18.

Housing 10 may also be provided with a cover position sensor 97 which communicates with PLC 55 such that PLC 55 interrupts movement of any of the advancers or controllers when cover 11 is opened.

Figure 6:
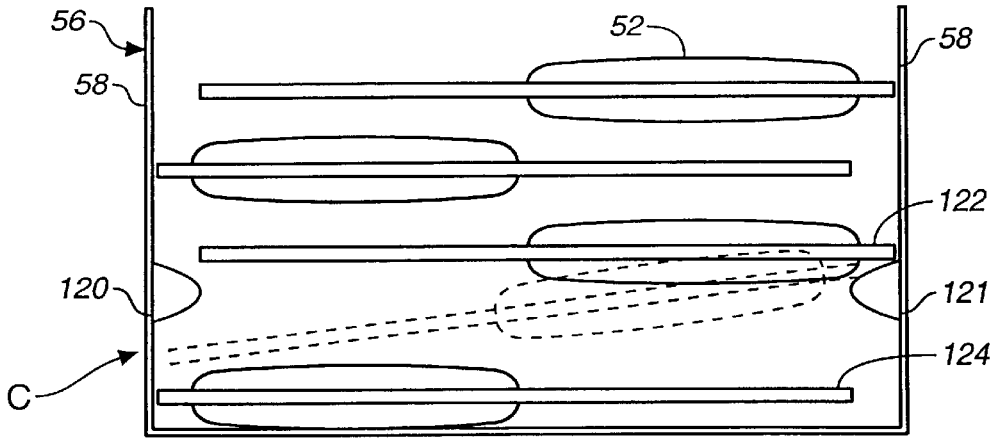
FIG. 6 is a side elevational view of a magazine according to an alternative embodiment of the present invention.

A further alternative embodiment of magazine 56 is shown in FIG. 6. It has been found that when a large number of ampoule cards 52 are stacked into magazine 56, the weight of the stacked ampoule cards 52 causes friction between the ampoule cards 122 and 124 near the bottom of the stack such that ampoule card 124 cannot be ejected from magazine 56. As shown in the figure, magazine 56 contains a stack of ampoule cards 52 and includes protrusions 120, 121 on an inner surface of walls 58. The protrusions 120, 121 are positioned so as to inhibit the downward movement of ampoule cards 52 within magazine 56. For example, when a stack of ampoule cards 52 is inserted into magazine 56 as shown in FIG. 6, one ampoule card will fall to the bottom of magazine 56. However, because of the arrangement of protrusions 120, 121, the ampoule card 122 which is above the bottom ampoule card 124, does not completely pass protrusions 120, 121. Protrusions 120, 121 and ampoule card 122 thereby support a portion of the weight of the above stack of ampoule cards 52. Protrusions 120, 121 may be positioned such that before ampoule card 124 is ejected from magazine 65, ampoule card 122 falls to position C as shown in broken lines in FIG. 5. In that position, protrusion 121 engages the enlarged end 51 of ampoule card 122 while the flat end 53 rotates downwardly into contact with ampoule card 124. Ampoule card 122 remains in position C until ampoule card 124 is ejected from magazine 56. Once card 124 is ejected, card 122 can further rotate downwardly and slide horizontally, as viewed in the figure, so that the enlarged end 51 can move past projection 121 and fall into the bottom of magazine 56, and in position to be ejected therefrom. Alternatively, protrusions 120 and 121 may independently located at different heights from the bottom of magazine 56. In this embodiment, a plurality of ampoule cards (e.g. 4, 5, 6, etc) may be stacked between the bottom of magazine 56 and the lower protrusion.

Figure 7:
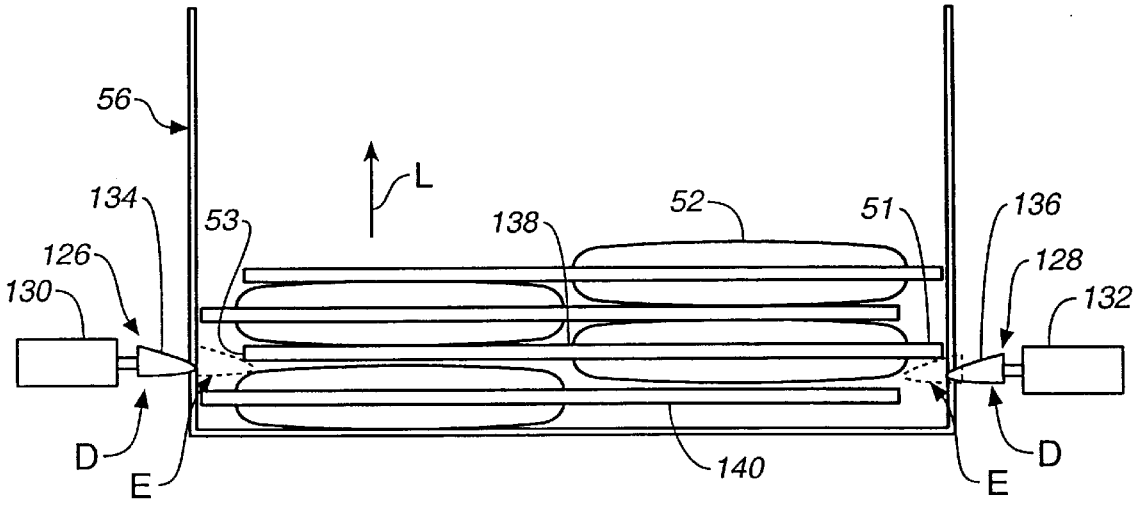
FIG. 7 is a side elevational view of a magazine accordin to a further alternative embodiment of the present invention.

FIG. 7 illustrates another alternative embodiment of magazine 56 wherein magazine 56 is provided with stops 126 and 128 which may be respectively mounted on stop advancers 130 and 132. Stop advancers 130, 132 may be constructed of electronic solenoids or servo motors, fluid cylinders, or any other known device capable of providing a thrust motion. In this embodiment, stops 126, 128 are provided on stop advancers 130, 132 so that stops 126, 128 can be moved between at least two positions. As shown in FIG. 6, stops 126, 128 can preferably be moved between position D where stops 126, 128 are outside of magazine 56 and position E (shown in broken lines) where stops 126, 128 are thrust into the interior of magazine 56. Preferably, stops 126, 128 are respectively provided with a inclined surfaces 134, 136. Provided as such, when stops 126, 128 are thrust into the interior of magazine 56 as shown in FIG. 6, stops 126, 128 respectively contact the flat end 53 and the enlarged end 51 of ampoule card 138, and thereby apply a lifting force, in the direction of arrow L, to ampoule card 138 which counter-acts at least a portion of the downward force acting on ampoule card 140 due to the weight of the stacked ampoule cards 52 in magazine 56. By providing such a lifting force, ampoule card 140 is relieved of the weight of the stacked ampoule cards 52 and is thereby free to be ejected from magazine 56.

Preferably, stop advancers 130, 132 are connected to and controlled by PLC 55. In operation, PLC 55 may control stop advancers 130, 132 such that stops 126, 128 are maintained in position E until magazine advancer 60 ejects an ampoule card 52 from magazine 56, then retracts to the home position shown in FIG. 1. When advancer 60 is retracted to the home position, magazine advancer home sensor 172 is thereby triggered which sends a signal to PLC 55 indicating advancer 60 is in the home position. Once PLC 55 receives the signal from magazine advancer home sensor 172, PLC 55 may signal stop advancers 130, 132 to retract stops 126, 128 to position D until the stack of ampoule cards 52 falls into the gap left by the ejected ampoule card 52. Once the stack of cards 52 has fallen, PLC 55 can signal stop advancers 130, 132 to advance stops 126, 128 to position E, and thereby apply a lifting force to the stacked ampoule cards 52.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An ampoule card splitting apparatus comprising:

a splitting guide having a laterally extending interior channel structurally configured to receive an ampoule card having a plurality of individual ampoules, said channel having an inlet aperture at a first end thereof configured to receive the ampoule card and a discharge aperture at a second end thereof, said splitting guide having a cutting path extending generally perpendicular to said channel, said splitting guide having a groove extending along said cutting path and into said channel;

a splitter member having a plurality of blades operatively associated with said splitter member, wherein said blades are structurally configured to split the ampoule card in said splitting guide along the cutting path when said splitting member is moved along the cutting path of said splitting guide and wherein said plurality of blades are provided in a non-rotational relationship with respect to said splitter member; and a splitter advancer operatively associated with said splitter member and structurally configured to move said splitter member along the cutting path of said splitting guide.

2. The apparatus as claimed in claim 1, wherein said splitter member is structurally configured to cut in two directions along the cutting path.

3. The apparatus as claimed in claim 2, wherein said plurality of blades includes a number of blades equal to one less than a number of ampoules of the plurality of individual ampoules included on the ampoule card, and wherein said number of blades is more than one and said number of ampoules is more than two.

4. The apparatus as claimed in claim 1, wherein said channel is structurally configured to anchor the ampoule card against a cutting force of said blades.

5. The apparatus as claimed in claim 4, wherein said splitting guide includes a number of grooves corresponding to the number of blades provided on said splitter member, wherein said grooves are structurally configured such that said blades substantially penetrate an interior of said channel.

6. The apparatus as claimed in claim 1, further comprising a gate provided adjacent said splitting guide and a gate controller for selectively opening or closing said gate, wherein said gate is provided adjacent the discharge aperture formed on said splitting apparatus.

7. The apparatus as claimed in claim 1, further comprising:

a rotating platform;

a rotating platform advancer;

a stating platform provided adjacent said splitting guide, structurally configured to align the ampoule card with said splitting guide; and a staging advancer structurally configured to move the ampoule card from said staging platform to said splitting guide;

wherein said rotating platform advancer is structurally configured to move the ampoule card provided on said rotating platform, from said rotating platform to said staging platform.

8. The apparatus as claimed in claim 7, wherein said rotating platform is structurally configured to rotate alternating ampoule cards fed to the rotating platform before the ampoule cards are moved to said staging platform.

9. The apparatus as claimed in claim 7, further comprising a magazine for storing a plurality of ampoule cards, and a magazine advancer structurally configured to move at least one ampoule card from said magazine to said rotating platform, wherein said plurality of ampoule cards are stacked in alternately opposite directions, and wherein said magazine is provided adjacent to said rotating platform.

10. The apparatus as claimed in claim 1, further comprising a magazine structurally configured to store a plurality of ampoule cards, wherein said magazine is provided adjacent to said splitting guide.

11. The apparatus as claimed in claim 1, further comprising a discharge chute structurally configured to receive an ampoule card, wherein said chute is provided adjacent the discharge aperture provided in said splitting apparatus, wherein an input end of said discharge chute is provided adjacent said discharge chute and an output end of said discharge chute is provided adjacent a conveyor.

12. An article splitting apparatus comprising:

a splitting guide having a laterally extending interior channel structurally configured to receive therein an article to be split, said channel having an inlet aperture at a first end thereof configured to receive the article and a discharge aperture at a second end thereof, said splitting guide having a cutting path extending generally perpendicular to said channel, said splitting guide having a groove extending along said cutting path and into said channel;

a splitter member having a plurality of blades operatively associated with said splitter member, wherein said blades are structurally configured to cut the article received by said splitting guide when said splitting member is moved along the cutting path of said splitting guide and wherein said plurality of blades are provided in a non-rotational relationship with respect to said splitter member;

a splitter advancer operatively associated with said splitter member and configured to move said splitter member along the cutting path of said splitting guide; and a rotating platform structurally configured to selectively rotate articles provided to the rotating platform before the articles are moved to said splitting guide.

13. The apparatus as claimed in claim 12, wherein said splitter member is structurally configured to cut in two directions along said cutting path.

14. The apparatus as claimed in claim 13, wherein said plurality of blades includes a number of blades equal to one less than a number of pieces of the article is to be split into, and wherein said number of blades is more than one and said number of pieces is more than two.

15. The apparatus as claimed in claim 12, wherein said channel is structurally configured to anchor the article against a cutting force of said blades.

16. The apparatus as claimed in claim 15, wherein said splitting guide includes a number of grooves corresponding to the number of blades provided on said splitter member wherein said grooves are structurally configured such that said blades substantially penetrate an interior of said channel.

17. The apparatus as claimed in claim 12, further comprising:

a gate provided adjacent the discharge aperture formed on said splitting guide; and a gate controller for selectively opening or closing said gate.

18. The apparatus as claimed in claim 12, wherein said rotating platform is structurally configured to rotate alternating articles fed to the rotating platform before the articles are moved to a staging platform.

19. The apparatus as claimed in claim 12, further comprising a magazine for storing a plurality of articles, and a magazine advancer structurally configured to move at least one article from said magazine to said rotating platform, wherein the plurality of articles are stacked in alternately opposite directions, and wherein said magazine is provided adjacent to said rotating platform.

20. The apparatus as claimed in claim 12, further comprising a discharge chute structurally configured to receive the article, wherein said chute is provided adjacent the discharge aperture provided in said splitting apparatus, wherein an input end of said discharge chute is provided adjacent said discharge chute and an output end of said discharge chute is provided adjacent a conveyor.

21. A splitting apparatus comprising:

anchoring means having a laterally extending interior channel for anchoring an ampoule card which includes a plurality of individual ampoules, said channel having an inlet aperture at a first end thereof configured to receive the ampoule card and a discharge aperture at a second end thereof, said anchoring means having a cutting path extending generally perpendicular to said channel, said anchoring means having a groove extending along said cutting path and into said channel; and splitting means for splitting the ampoule card anchored by said anchoring means along said cutting path, wherein said splitting means comprises a plurality of non-rotational blades.

22. The apparatus as claimed in claim 21, wherein said splitting means comprises:

splitting member means including said plurality of blades;

splitting member advancer means for moving said splitter member means along said cutting path, wherein said splitting member advancer means is structurally configured to move said splitter member means to split ampoule cards in two directions.

23. The apparatus as claimed in claim 21, further comprising staging means adjacent said anchoring means for aligning the ampoule card with the inlet aperture to said anchoring means and staging advancement means for moving ampoule cards from said staging means to said anchoring means.

24. The apparatus as claimed in claim 21, further comprising staging advancement means comprising a pneumatic cylinder.

25. The apparatus as claimed in claim 21, further comprising:

a gate member provided adjacent the discharge aperture formed in said anchoring means; and gate controller means for selectively moving said gate member between an open position where said gate member is not blocking said discharge aperture and a closed position where said gate member is blocking said discharge aperture provided in said anchoring means.

26. The apparatus as claimed in claim 25, wherein said gate controller means is a pneumatic cylinder.

27. The apparatus as claimed in claim 21, further comprising rotating means for rotating the ampoule card before the ampoule card is moved to said anchoring means.

28. The apparatus as claimed in claim 27, wherein a plurality of ampoule cards are provided in a series, alternately facing opposite directions.

29. The apparatus as claimed in claim 27, wherein said rotating means is structurally configured to rotate every other ampoule card fed to the rotating platform.

30. The apparatus as claimed in claim 29, further comprising a magazine structurally configured to feed a plurality of vertically stacked ampoule cards to said rotating means, wherein said plurality of vertically stacked ampoule cards are stacked alternately facing opposite directions.

31. The apparatus as claimed in claim 21, further comprising feeding means for feeding a plurality of ampoule cards to said splitting apparatus.

32. The apparatus as claimed in claim 31, wherein said feeding means comprises a magazine structurally configured to feed a plurality of vertically stacked ampoule cards to said splitting apparatus.

* * * * *